US006125593A

United States Patent [19]

Randolph et al.

[11] Patent Number: 6,125,593

[45] Date of Patent: Oct. 3, 2000

[54] SELF-PIERCING GUTTER OUTLET

[76] Inventors: Darwin Randolph; Mary Randolph, both of 13325 Loretto, Detroit, Mich. 48205

[21] Appl. No.: 09/213,119

[22] Filed: Dec. 17, 1998

[51] Int. Cl.[7] ..... E04D 13/08

[52] U.S. Cl. ..... 52/16; 52/11; 52/DIG. 1; 408/204; 408/703

[58] Field of Search ..... 52/11, 16, DIG. 1; 408/204, 703

[56] References Cited

U.S. PATENT DOCUMENTS 254,286 2/1882 Dellenbaugh ..... 408/703

4,328,694 5/1982 Beaumont ..... 52/16

4,619,554 10/1986 Walker et al. ..... 52/16

5,867,943 2/1999 Thomas ..... 52/16

*Primary Examiner*—Beth A. Stephan

*Assistant Examiner*—Dennis L. Dorsey

[57] ABSTRACT

A self-piercing gutter outlet for connecting a downspout to a gutter. The self-piercing gutter outlet includes a tubular sleeve having open top and bottom ends. An outwardly radiating upper flange is extended around the sleeve at the top end of the sleeve. The bottom end of the sleeve has a serrated lower edge therearound.

10 Claims, 2 Drawing Sheets

SELF-PIERCING GUTTER OUTLET

BACKGROUND OF THE INVENTION

1. Field of the Invention

The present invention relates to gutter outlets and more particularly pertains to a new self-piercing gutter outlet for connecting a downspout to a gutter.

2. Description of the Prior Art

The use of gutter outlets, also known as gutter drops and mouths, is known in the prior art. More specifically, gutter outlets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,711,012 by Wolters; U.S. Pat. No. 2,237,069 by Christenson; U.S. Pat. No. 3,589,159 by Warstler; U.S. Pat. No. 3,987,712 by Croteau; U.S. Pat. No. 4,730,395 by Blessing, Sr.; and U.S. Pat. No. Des. 341,145 by Esworthy.

While these devices fulfill their respective, particular objectives and requirements, the aforementioned patents do not disclose a new self-piercing gutter outlet. The inventive device includes a tubular sleeve having open top and bottom ends. An outwardly radiating upper flange is extended around the sleeve at the top end of the sleeve. The bottom end of the sleeve has a serrated lower edge therearound.

In these respects, the self-piercing gutter outlet according to the present invention substantially departs from the conventional concepts and designs of the prior art, and in so doing provides an apparatus primarily developed for the purpose of connecting a downspout to a gutter.

SUMMARY OF THE INVENTION

In view of the foregoing disadvantages inherent in the known types of gutter outlets now present in the prior art, the present invention provides a new self-piercing gutter outlet construction wherein the same can be utilized for connecting a downspout to a gutter.

The general purpose of the present invention, which will be described subsequently in greater detail, is to provide a new self-piercing gutter outlet apparatus and method which has many of the advantages of the gutter outlets mentioned heretofore and many novel features that result in a new self-piercing gutter outlet which is not anticipated, rendered obvious, suggested, or even implied by any of the prior art gutter outlets, either alone or in any combination thereof.

To attain this, the present invention generally comprises a tubular sleeve having open top and bottom ends. An outwardly radiating upper flange is extended around the sleeve at the top end of the sleeve. The bottom end of the sleeve has a serrated lower edge therearound.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new self-piercing gutter outlet apparatus and method which has many of the advantages of the gutter outlets mentioned heretofore and many novel features that result in a new self-piercing gutter outlet which is not anticipated, rendered obvious, suggested, or even implied by any of the prior art gutter outlets, either alone or in any combination thereof.

It is another object of the present invention to provide a new self-piercing gutter outlet which may be easily and efficiently manufactured and marketed.

It is a further object of the present invention to provide a new self-piercing gutter outlet which is of a durable and reliable construction.

An even further object of the present invention is to provide a new self-piercing gutter outlet which is susceptible of a low cost of manufacture with regard to both materials and labor, and which accordingly is then susceptible of low prices of sale to the consuming public, thereby making such self-piercing gutter outlet economically available to the buying public.

Still yet another object of the present invention is to provide a new self-piercing gutter outlet which provides in the apparatuses and methods of the prior art some of the advantages thereof, while simultaneously overcoming some of the disadvantages normally associated therewith.

Still another object of the present invention is to provide a new self-piercing gutter outlet for connecting a downspout to a gutter.

Yet another object of the present invention is to provide a new self-piercing gutter outlet which includes a tubular sleeve having open top and bottom ends. An outwardly radiating upper flange is extended around the sleeve at the top end of the sleeve. The bottom end of the sleeve has a serrated lower edge therearound.

Traditionally, three steps are required for installing a gutter outlet: first, tracing the outline of a gutter outlet on a gutter, second, cutting a hole through the gutter along the traced outline, and then third, dropping the gutter outlet through the hole. Still yet another object of the present invention is to provide a new time-saving self-piercing gutter outlet that pierces its own hole through a gutter as the gutter outlet is driven into the gutter to combine the three steps of installing a traditional gutter outlet into a single step.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
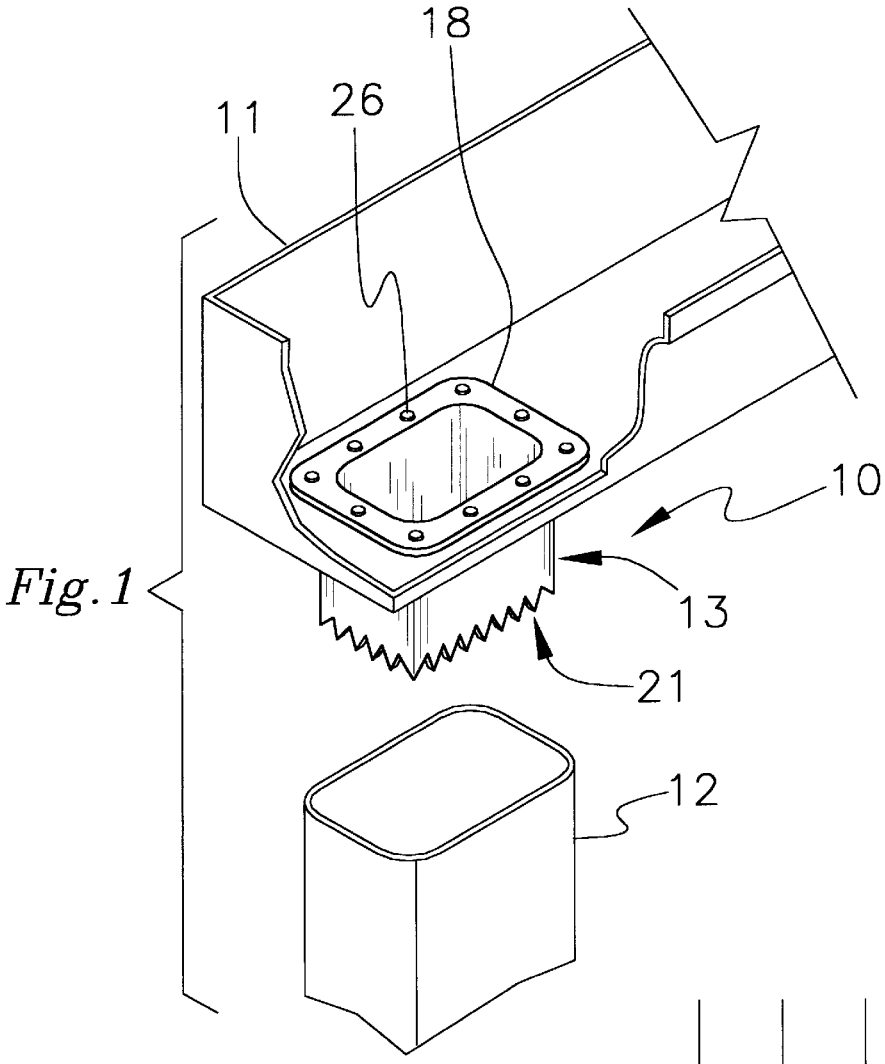
FIG. 1 is a schematic perspective view of a new self-piercing gutter outlet in use according to the present invention.
Figure 2:
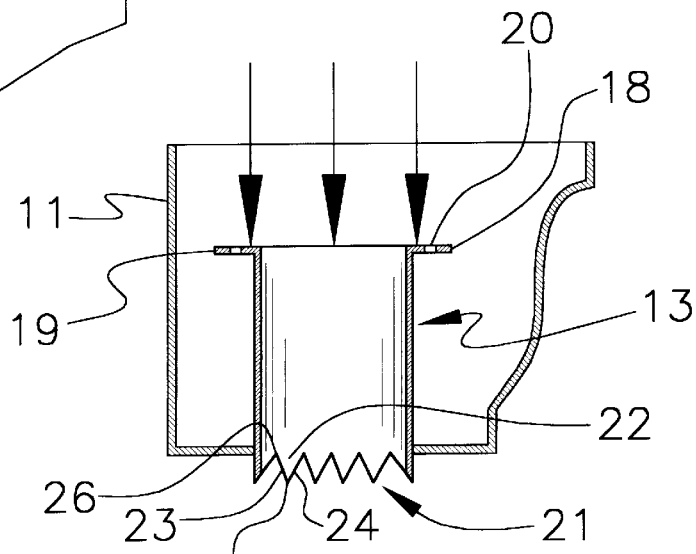
FIG. 2 is a schematic cross sectional view of the present invention illustrating the direction the gutter outlet is driven through the gutter to pierce through the gutter so that the bottom end of the gutter outlet downwardly depends from the gutter.
Figure 3:
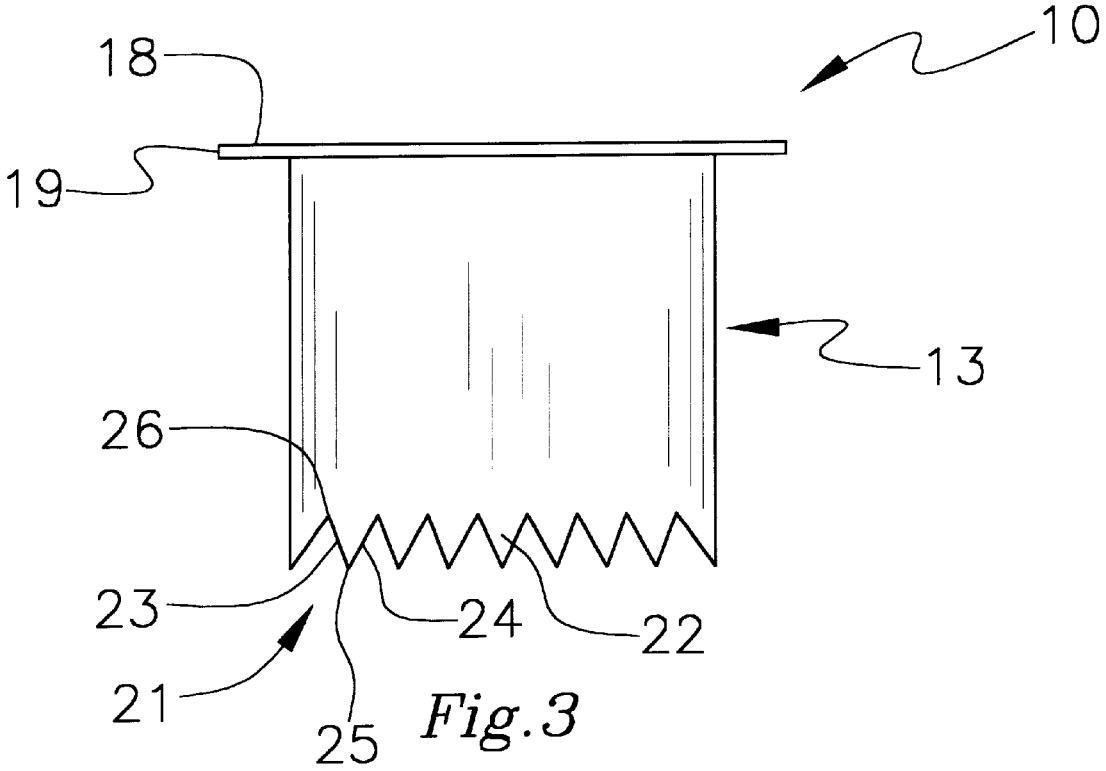
FIG. 3 is a schematic side view of the present invention.
Figure 4:
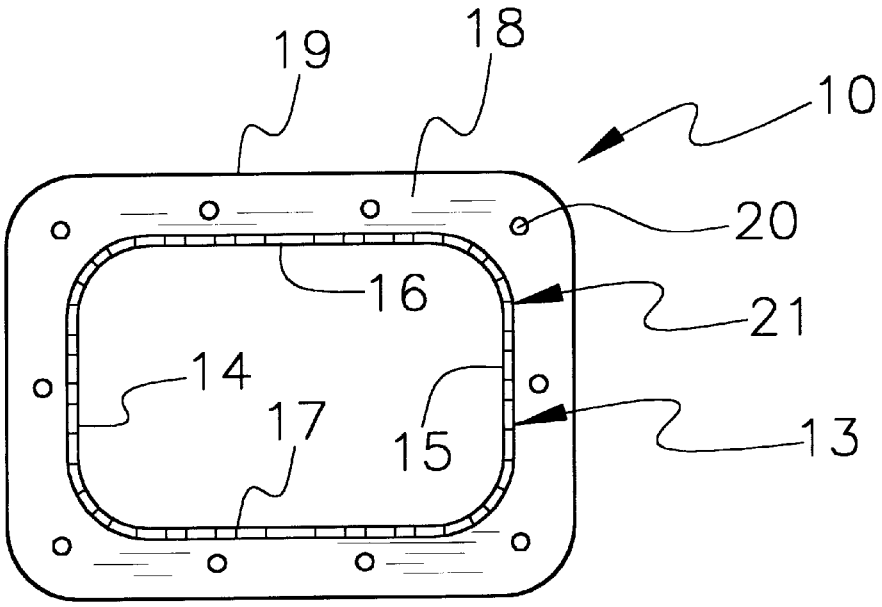
FIG. 4 is a schematic bottom view of the present invention.

With reference now to the drawings, and in particular to FIGS. 1 through 4 thereof, a new self-piercing gutter outlet embodying the principles and concepts of the present invention and generally designated by the reference numeral 10 will be described.

As best illustrated in FIGS. 1 through 4, the self-piercing gutter outlet 10 generally comprises a tubular sleeve having open top and bottom ends. An outwardly radiating upper flange is extended around the sleeve at the top end of the sleeve. The bottom end of the sleeve has a serrated lower edge therearound.

In use, the gutter outlet 10 is designed for fluidly connecting a gutter 11 to a downspout 12. In closer detail, the gutter outlet comprises a tubular sleeve 13 having open top and bottom ends, and an axis extending between the top and bottom ends of the sleeve. The top and bottom ends of the sleeve preferably lie in generally parallel planes with one another substantially perpendicular to the axis of the sleeve.

In a preferred embodiment, the sleeve has a rectangular shape with first and second pairs of substantially parallel opposite sides, and four corner edges. It is also note that the sleeve may also preferably be circular, oval or any other shape used for gutter outlets. Ideally, in the rectangular embodiment, the corner edges of the sleeve are rounded. The sleeve has a height defined between the top and bottom ends of the sleeve, a width defined between the first pair of opposite sides 14,15, and a depth defined between the second pair of opposite sides 16,17. Preferably, the width of the sleeve is greater than the height of the sleeve and the width of the sleeve is greater than the depth of the sleeve. Even more preferably, the height and depth of the sleeve are about equal to one another in this preferred rectangular embodiment. In an ideal illustrative rectangular embodiment the width of the sleeve is about 4 inches and the height and the depth of the sleeve are each about 3 inches.

An outwardly radiating upper flange 18 is extended around the sleeve at the top end of the sleeve. The upper flange preferably has the same shape as the sleeve. In the rectangular embodiment, the upper flange has four rounded corners. The upper flange preferably lies in a plane substantially perpendicular to the axis of the sleeve. The upper flange has an outer edge and a width defined between the sleeve and the outer edge of ideally about 1 inch.

The upper flange has a plurality of generally circular holes 20 therethrough. The holes of the upper flange are preferably spaced apart at generally equal intervals along the upper flange around the sleeve. The holes of the upper flange each are preferably generally equidistantly spaced between the sleeve and the outer edge of the upper flange. In an ideal illustrative rectangular embodiment, the plurality of holes of the upper flange comprises 10 holes to optimally provide a sufficient seal between the gutter and the flange when coupled together with fasteners extended through the holes of the upper flange into the gutter.

The bottom end of the sleeve has a serrated lower edge 21 therearound. In use, the serrated lower edge is designed for cutting through a gutter when the bottom end of the sleeve is driven into the gutter to form a hole in the gutter through which the sleeve is extended. Ideally, the gutter outlet comprises a metal material so that the serrated lower edge can cut through gutters made of metal and vinyl.

The serrated lower edge comprises a plurality of generally V-shaped teeth 22 or serrations. The teeth each have a pair of side portions 23,24 converging together to form a lower point 25. Preferably, the side portions of each tooth are extended at an acute angle to one another and, even more preferably, the side portions of each tooth are extended at an acute angle to the adjacent side portion of an adjacent tooth. The side portions of each adjacent pair of teeth forming a valley 26 therebetween.

The lower points of the teeth preferably substantially lie in a common plane with one another. Similarly, the valleys of the teeth preferably substantially lie in a common plane with one another substantially parallel to the plane of the lower points. In this preferred embodiment, the serrated lower edge has a depth defined between planes of the lower points and the valleys of between about ⅛ inch and about 1 inch. Ideally, the depth of the serrated lower edge is about ½ inch.

In use, the serrated lower edge of the sleeve is positioned against a gutter. The serrated lower edge is then driven through the gutter such that the sleeve is extended through a hole in the gutter formed by serrated lower edge. Ideally, the serrated lower edge is driven through the gutter by striking the top end of the sleeve with a hammer or other striking tool to drive the serrated lower edge through the gutter.

Next, the sleeve is slid through the hole in the gutter so that the upper flange is positioned against the gutter. The upper flange is then coupled to the gutter by extending fasteners 27 (such as rivets) through the holes of the upper flange into the gutter such that the upper flange is coupled to the gutter. Finally, the bottom end of the sleeve is coupled to an upper end of a downspout preferably by inserting the bottom end of the sleeve into the upper end of the downspout.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gutter outlet, comprising:

a tubular sleeve having open top and bottom ends, and an axis extending between said top and bottom ends of said sleeve;

an outwardly radiating upper flange being extended around said sleeve at said top end of said sleeve; and said bottom end of said sleeve having a serrated lower edge therearound;

wherein said sleeve has a rectangular shape and has first and second pairs of substantially parallel opposite sides, and four corner edges, wherein said corner edges of said sleeve are rounded; and wherein said upper flange has a plurality of holes therethrough, wherein said holes of said upper flange are spaced apart at generally equal intervals along said upper flange around said sleeve.

2. The gutter outlet of claim 1, wherein said top and bottom ends of said sleeve lie in generally parallel planes with one another substantially perpendicular to said axis of said sleeve.

3. The gutter outlet of claim 1, wherein said sleeve has a height defined between said top and bottom ends of said sleeve, a width defined between said first pair of opposite sides, and a depth defined between said second pair of opposite sides, wherein said width of said sleeve is greater than said height of said sleeve and said width of said sleeve is greater than said depth of said sleeve.

4. The gutter outlet of claim 3, wherein said height and depth of said sleeve are about equal to one another.

5. The gutter outlet of claim 1, wherein said sleeve has a circular shape.

6. The gutter outlet of claim 1, wherein said sleeve has an oval shape.

7. The gutter outlet of claim 1, wherein said serrated lower edge comprises a plurality of generally V-shaped teeth, said teeth each having a pair of side portions converging together to form a lower point.

8. The gutter outlet of claim 7, wherein said side portions of each tooth are extended at an acute angle to one another and wherein said side portions of each tooth are extended at an acute angle to the adjacent side portion of an adjacent tooth.

9. A gutter outlet for fluidly connecting a gutter to a downspout, said gutter outlet comprising:

a tubular sleeve having open top and bottom ends, and an axis extending between said top and bottom ends of said sleeve;

said top and bottom ends of said sleeve lying in generally parallel planes with one another substantially perpendicular to said axis of said sleeve;

wherein said sleeve has a rectangular shape and has first and second pairs of substantially parallel opposite sides, and four corner edges;

said corner edges of said sleeve being rounded;

said sleeve having a height defined between said top and bottom ends of said sleeve, a width defined between said first pair of opposite sides, and a depth defined between said second pair of opposite sides;

said width of said sleeve being greater than said height of said sleeve, said width of said sleeve being greater than said depth of said sleeve;

said height and depth of said sleeve being about equal to one another;

an outwardly radiating upper flange being extended around said sleeve at said top end of said sleeve;

said upper flange having a generally rectangular shape;

said upper flange having four rounded corners;

said upper flange lying in a plane substantially perpendicular to said axis of said sleeve;

said upper flange having an outer edge;

said upper flange having a plurality of generally circular holes therethrough;

said holes of said upper flange being spaced apart at generally equal intervals along said upper flange around said sleeve;

said holes of said upper flange each being generally equidistantly spaced between said sleeve and said outer edge of said upper flange;

said bottom end of said sleeve having a serrated lower edge therearound;

said serrated lower edge being adapted for cutting through a gutter when said bottom end of said sleeve is driven into the gutter to form a hole in said gutter through which said sleeve is extended;

said serrated lower edge comprising a plurality of generally V-shaped teeth, said teeth each having a pair of side portions converging together to form a lower point;

said side portions of each tooth being extended at an acute angle to one another, said side portions of each tooth being extended at an acute angle to the adjacent side portion of an adjacent tooth;

said side portions of each adjacent pair of teeth forming a valley therebetween;

said lower points of said teeth substantially lying in a common plane with one another, said valleys of said teeth substantially lying in a common plane with one another substantially parallel to said plane of said lower points; and said serrated lower edge having a depth defined between planes of said lower points and said valleys of between about ⅛ inch and about 1 inch.

10. A method for coupling a downspout to a gutter, comprising the acts of:

providing a gutter outlet comprising:

a tubular sleeve having open top and bottom ends, and an axis extending between said top and bottom ends of said sleeve;

said top and bottom ends of said sleeve lying in generally parallel planes with one another substantially perpendicular to said axis of said sleeve;

wherein said sleeve has a rectangular shape and has first and second pairs of substantially parallel opposite sides, and four corner edges;

said corner edges of said sleeve being rounded;

said sleeve having a height defined between said top and bottom ends of said sleeve, a width defined between said first pair of opposite sides, and a depth defined between said second pair of opposite sides;

said width of said sleeve being greater than said height of said sleeve, said width of said sleeve being greater than said depth of said sleeve;

said height and depth of said sleeve being about equal to one another;

an outwardly radiating upper flange being extended around said sleeve at said top end of said sleeve;

said upper flange having a generally rectangular shape;

said upper flange having four rounded corners;

said upper flange lying in a plane substantially perpendicular to said axis of said sleeve;

said upper flange having an outer edge;

said upper flange having a plurality of generally circular holes therethrough;

said holes of said upper flange being spaced apart at generally equal intervals along said upper flange around said sleeve;

said holes of said upper flange each being generally equidistantly spaced between said sleeve and said outer edge of said upper flange;

said bottom end of said sleeve having a serrated lower edge therearound;

said serrated lower edge being adapted for cutting through a gutter when said bottom end of said sleeve is driven into the gutter to form a hole in said gutter through which said sleeve is extended;

said serrated lower edge comprising a plurality of generally V-shaped teeth, said teeth each having a pair of side portions converging together to form a lower point;

said side portions of each tooth being extended at an acute angle to one another, said side portions of each tooth being extended at an acute angle to the adjacent side portion of an adjacent tooth;

said side portions of each adjacent pair of teeth forming a valley therebetween;

said lower points of said teeth substantially lying in a common plane with one another, said valleys of said teeth substantially lying in a common plane with one another substantially parallel to said plane of said lower points; and said serrated lower edge having a depth defined between planes of said lower points and said valleys of between about ⅛ inch and about 1 inch;

positioning said serrated lower edge of said sleeve against a gutter;

driving said serrated lower edge through said gutter such that said sleeve is extended through a hole in said gutter formed by serrated lower edge;

wherein said act of driving said serrated lower edge through said gutter further comprises the act of striking said top end of said sleeve to drive said serrated lower edge through said gutter;

positioning said upper flange against said gutter;

coupling said upper flange to said gutter;

wherein said act of coupling said upper flange to said gutter further comprises the act of extending fasteners through said holes of said upper flange into said gutter such that said upper flange is coupled to said gutter;

wherein said fasteners comprise rivets;

coupling said bottom end of said sleeve to an upper end of a downspout; and wherein said act of coupling said bottom end of said sleeve to an upper end of a downspout further comprises the act of inserting said bottom end of said sleeve into said upper end of said downspout.

* * * * *